US007180481B2

(12) United States Patent
Yamada

(10) Patent No.: US 7,180,481 B2
(45) Date of Patent: Feb. 20, 2007

(54) PLASMA DISPLAY AND ITS DRIVING METHOD

(75) Inventor: Kazuhiro Yamada, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 111 days.

(21) Appl. No.: 10/480,031

(22) PCT Filed: Jun. 6, 2002

(86) PCT No.: PCT/JP02/05576

§ 371 (c)(1),
(2), (4) Date: Jul. 12, 2004

(87) PCT Pub. No.: WO02/101704

PCT Pub. Date: Dec. 19, 2002

(65) Prior Publication Data

US 2004/0246207 A1 Dec. 9, 2004

(30) Foreign Application Priority Data

Jun. 12, 2001 (JP) ..... 2001-176581

(51) Int. Cl.
*G09G 3/10* (2006.01)
*G09G 3/28* (2006.01)

(52) U.S. Cl. ..... 345/63; 345/68; 345/41

(58) Field of Classification Search ..... 345/60, 345/41, 63

See application file for complete search history.

(56) References Cited

U.S. PATENT DOCUMENTS

| | | | | |
|---|---|---|---|---|
| 5,684,499 | A | 11/1997 | Shimizu et al. | 345/60 |
| 6,052,105 | A | 4/2000 | Yamamoto et al. | 345/94 |
| 6,278,422 | B1 * | 8/2001 | Ukai et al. | 345/63 |
| 6,653,993 | B1 | 11/2003 | Nagao et al. | 345/60 |
| 6,784,858 | B2 * | 8/2004 | Awamoto | 345/60 |
| 2002/0063662 | A1 * | 5/2002 | Nagakubo et al. | 345/60 |

FOREIGN PATENT DOCUMENTS

| | | |
|---|---|---|
| JP | 03238497 | 10/1991 |
| JP | 07044130 | 2/1995 |
| JP | 8-44315 | 2/1996 |
| JP | 10319894 | 12/1998 |
| JP | 11052913 | 2/1999 |
| JP | 11065517 | 3/1999 |
| JP | 2000-020024 | 1/2000 |
| JP | 2000-148083 | 5/2000 |
| WO | WO 97/20301 | 6/1997 |

* cited by examiner

*Primary Examiner*—Kent Chang
*Assistant Examiner*—Donna Lui

(57) ABSTRACT

A PDP display apparatus driving method for performing multi-level gradation display by constituting one frame of a plurality of subfields assigned different weights, wherein in a subfield in which a relative luminance ratio corresponds to a lowest weight, display is performed according to discharges in two periods only, the periods being an initialization period and a write period.

9 Claims, 16 Drawing Sheets

VERTICAL SYNCHRONIZATION SIGNAL

SIGNAL INVERTING EACH FIELD

HORIZONTAL SYNCHRONIZATION SIGNAL

DATA CLOCK

SIGNAL INVERTING EACH LINE

SIGNAL INVERTING EACH HORIZONTAL DOT

FIG.11

PRIOR ART

| WEIGHT | 1 | 2 | 4 | 8 | 16 | 32 | 64 | 128 | DISPLAY LUMINANCE[cd/m²] |
|---|---|---|---|---|---|---|---|---|---|
| 0TH GRADATION | | | | | | | | | 0,15 |
| 1ST GRADATION | 1 | | | | | | | | 2.49 |
| 2ND GRADATION | | 1 | | | | | | | 4.29 |
| 3RD GRADATION | 1 | 1 | | | | | | | 6.62 |
| 4TH GRADATION | | | 1 | | | | | | 7.89 |
| 5TH GRADATION | 1 | | 1 | | | | | | 10.22 |
| 6TH GRADATION | | 1 | 1 | | | | | | 12.02 |
| 7TH GRADATION | 1 | 1 | 1 | | | | | | 14.36 |
| 8TH GRADATION | | | | 1 | | | | | 15.09 |
| : | | | | | | | | | : |

| 1 | : SUB-FIELD PERFORMING WRITE AND SUSTAIN DISCHARGES |
|---|---|
| | : SUB-FIELD NOT PERFORMING WRITE AND SUSTAIN DISCHARGES |

PLASMA DISPLAY AND ITS DRIVING METHOD

TECHNICAL FIELD

The present invention relates to a plasma display panel display device and its driving method.

BACKGROUND ART

A plasma display panel (PDP) display device includes a PDP unit being composed of a thin front glass panel and a thin back glass panel arranged facing each other via a plurality of barrier ribs, having fluorescent layers of each of the colors red (R), green (G), and blue (B) applied between the barrier ribs, and discharge gas enclosed in a discharge space which is a gap between the two glass panels. A plurality of pairs of display electrodes, each pair consisting of a scan electrode and a sustain electrode, are formed on the front glass panel. Also, a plurality of address electrodes are aligned on the back glass panel, so as to be perpendicular to the display electrodes, the discharge space being between the address electrodes and display electrodes. In a subfield (which is described later), each of the electrodes is applied with pulses such as initialization pulses, scan pulses, write pulses, sustain pulses, and erase pulses, based on, for example, the drive waveform process shown in FIG. 15, so that fluorescent light is emitted according to the electric discharge generated in the discharge gas. A PDP display device having this kind of construction is superior to a conventional CRT display in that it does not involve problems including limitations in viewing angles and increased depth and weight when a large screen PDP is produced, as a large screen conventional display CRT does.

There is much demand for this kind of large screen, high definition PDP display device, and at present PDP display devices of 50 inches or more in size are being commercially produced.

Note that when a television video is shown on a display using an analog color television video signal system, one second of an image is constructed from 60 frames (or fields). In a basic PDP display device, because image display is basically possible only by illumination and extinction, a method for displaying halftones is used in which the illumination time corresponding to each of the colors red (R), green (G) and blue (B) is time-shared, as shown in the frame structure diagram FIG. 16. For example a plurality of level gradation display times are in accordance with a combination of eight subfields which constitute 1 (TV) frame. The relative luminance ratios of each of the eight subfields are assigned, in ascending order, binary weights such as 1, 2, 4, 8, 16, 32, 64, 128, and display, for example, a total of 256 gradations (level 0 gradation to level 255 gradation) according to a combination of the different weights of the 8 bit relative luminance ratio. Further, in order to maintain a sufficient brightness during actual operation, a number of sustain pulses to be applied during the discharge sustain period of each subfield is substantially set in proportion with the assigned weight. It is supposed that the number of pulses, in the described relative luminance ratio order is 3, 7, 15, 31, 63, 127, 255, 511 (wherein "level 0 gradation", "level 1 gradation", "level 2 gradation" to "level 8 gradation" and so on, which are described later, show specific level gradations included in 256 total gradations).

A PDP display device having the above characteristics incurs the following problems during low-level gradation display.

Namely, in display it is generally desirable that the relative luminance ratio decreases as the gradation level of the display becomes lower, as this allows dark gradation display to be expressed smoothly. When using a CRT to display, of the total 256 gradations, level 0 gradation, and level 1 gradation which has a relative luminance ratio corresponding to the smallest weight, the luminance ratio showing the difference in gradation level is close to 0 cd/m$^2$, and a smooth gradation display time is possible. However in a PDP display device, the luminance ratio of level 0 gradation and level 1 gradation is no less than 2 cd/m$^2$, therefore it is difficult to display such a change in luminance as smoothly as in a CRT device.

In response to this problem, if the sustain pulse rate is set at a very low gradation setting, light emission gained by sustain pulses during the level 1 gradation display time can be restricted, however because light emission is left over from the initialization pulse, write pulse, and erase pulse, luminance cannot be substantially lowered. Further, even if gradation display time is falsely attempted using error diffusion processing (dither method), error diffusion noise is noticeable on the screen because the gradation level is low, and rather than an effective error diffusion result being gained, a new problem of deterioration in picture quality arises.

DISCLOSURE OF THE INVENTION

In consideration of the abovementioned problems, the aim of the present invention is to provide a PDP display device and driving method therefor, capable of offering superior performance during low-level gradation display when performing multi-level gradation display.

In order to solve the abovementioned problems, the present invention is a PDP display apparatus driving method for performing multi-level gradation display by constituting one frame of a plurality of subfields assigned different weights, wherein in a subfield in which a relative luminance ratio corresponds to a lowest weight, display is performed according to discharges in two periods only, the periods being an initialization period and a write period.

According to this driving method, because emission luminance of the subfield having the lowest relative luminance ratio is displayed using the light emission of only the initialization period and the write period, the discharges in each of the sustain period and erase period are unnecessary. Therefore, in the present invention, emission luminance in a subfield having a lowest relative luminance ratio is dramatically restricted to approximately half of the conventional emission luminance, and of 256 total gradation levels, low-level gradation changes from level 0 gradation to level 1 gradation display time can be displayed smoothly based on this lowered emission luminance.

The PDP display apparatus may include a PDP unit with a plurality of cells arranged in a matrix formation, wherein in a first subfield, in which the relative luminance ratio corresponds to a lowest weight in a first frame, discharge is generated in the write period within a first group of cells selected from a display area having the lowest relative luminance ratio, and in a second subfield, in which the relative luminance ratio corresponds to a lowest weight in a second frame that is successive to the first frame, discharge is generated in the write period within a second group of cells selected from the display area having the lowest relative luminance ratio, in which discharge was not generated in the first subfield.

According to this driving method, the illumination of the display area of the subfield having a relative luminance ratio corresponding to the lowest weight, is shared between two frames, and as a result, the amount of light emission in the subfield that has the lowest relative luminance ratio of a frame can be reduced to about one quarter of the conventional amount. Accordingly, when using this driving method, dark light emission during display from level 0 gradation to level 1 gradation can be displayed even more smoothly.

Further, if display is performed using the discharges of only the initializing and write periods in a subfield having the second smallest relative luminance ratio of the frame, in the two successive subfields, the light emission having the lowest relative luminance ratio, and the light emission having the next smallest relative luminance ratio are able to be performed more smoothly than conventionally in a dark display, and a superior low-level gradation display time is realized.

Further, in the present invention, an initialization pulse which includes an accelerating shape in the initialization period of a subfield which succeeds the subfield having the lowest relative luminance ratio in the frame may be applied.

By this method, because the wall charge originating in the subfield having the lowest relative luminance ratio can be gradually initialized in the next subfield by the initializing discharge, and the occurrence of bright erroneous discharge can be effectively prevented, a smooth transition from the gradation display having the lowest relative luminance ratio to the next gradation display is possible, resulting in good display performance.

Note that the accelerating shape of the initialization pulse may be a shape selected from inclined, stepped, exponentially curved, and trigonometrically curved shapes.

The present invention may also be a PDP display apparatus comprising (a) a PDP unit composed of a first substrate having a plurality of pairs of display electrodes formed on a main surface thereof, and a second substrate having a plurality of data electrodes, a plurality of barrier ribs, and phosphor layers formed on a main surface thereof, the barrier ribs being aligned in a lengthwise direction of the data electrodes, and the phosphor layers being formed between pairs of adjacent barrier ribs, the first and second substrates being arranged so that the main surfaces face each other, and the lengthwise directions of the display electrodes and the data electrodes cross each other, and (b) a panel driving unit operable to drive the PDP unit by applying a voltage to an arbitrary pair of display electrodes and an arbitrary data electrode, based on a drive waveform process having a frame composed of a plurality of subfields assigned different weights, wherein the PDP has a structure such that the subfield having the lowest relative luminance ratio of the frame is constituted by two periods only, the periods being an initialization period and a write period, and the panel driving unit applies voltages to the data electrodes and the plurality of pairs of display electrodes according to the two periods.

BRIEF DESCRIPTION OF THE DRAWINGS

FIG. 11 shows the relationship between weights and gradation in a conventional PDP;

PREFERRED MODE FOR CARRYING OUT THE INVENTION

First Embodiment 1-1. Structure of the PDP

The PDP of the present first embodiment is made up of a PDP unit 1, and a panel driving unit 20 which drives the PDP unit 1.

Figure 12:
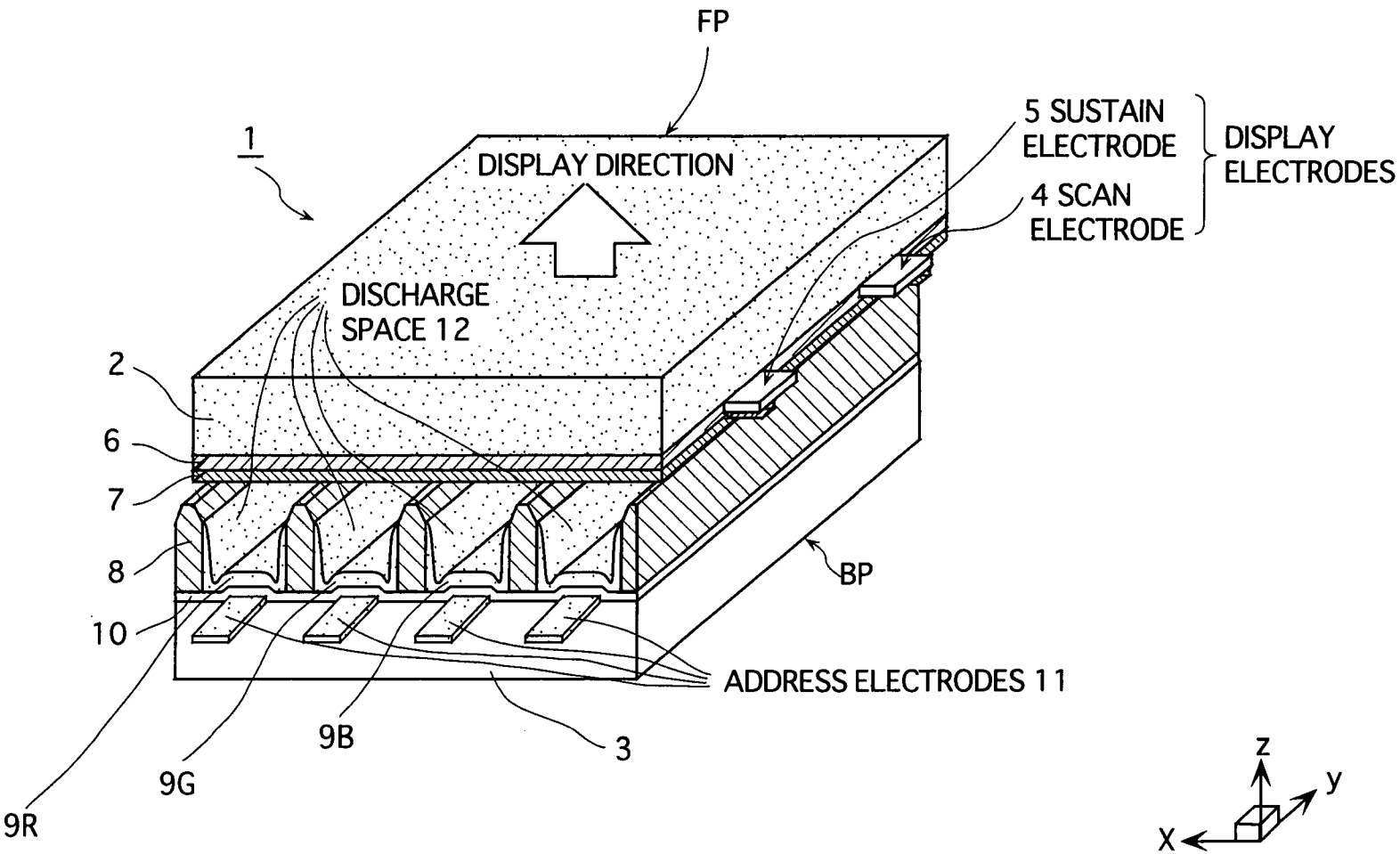
FIG. 12 is a cross-sectional perspective drawing of the structure of the PDP unit.

FIG. 12 is a partial and cross-sectional perspective drawing of the main structure of an AC surface discharge PDP unit of the first embodiment. In the drawing, a vertical direction z corresponds to a PDP thickness direction, and horizontal directions x and y correspond to a plane which is parallel to the PDP unit panel surface. As shown in the drawing, the PDP unit 1 is made up of a front panel FP and a back panel BP which are arranged with their main surfaces facing each other.

A plurality of pairs of display electrodes 4 and 5 (scan electrodes 4 and sustain electrode 5) are arranged lengthwise along the x direction on the main surface of a front glass panel 2, which is the substrate of the front panel FP, and surface discharge is performed between the scan and sustain electrodes of each display electrode pair. Here, as an example the display electrodes 4 and 5 are metal electrodes formed by mixing glass with Ag and baking the mixture, however a structure wherein a bus line is applied onto transparent electrodes made of ITO bandings may also be used.

Each scan electrode 4 is independently supplied with electrical charge. Further, all of the sustain electrodes 5 are connected so as to be charged with the same electrical potential.

The main surface of the front glass panel 2, which has the display electrodes 4 and 5 arranged thereon, is coated with a dielectric layer 6 made of insulative glass material, and a protective layer 7 made of magnesium oxide (MgO) in the stated order.

A plurality of address electrodes 11 are aligned lengthwise in the y direction in a stripe configuration with fixed intervals between the electrodes, on the main surface of a back glass panel 3, which is the substrate of the back panel BP. The address electrodes 11 are made by mixing Ag with glass, then baking the mixture.

The main surface of the back glass panel 3 which has address electrodes 11 arranged thereon is coated with a dielectric layer 10 made of insulative material. Barrier ribs 8 are arranged on the dielectric layer 10 in line with the gaps between pairs of adjacent address electrodes 11. Then, phosphor layers 9R, 9G, and 9B, which each correspond to one of red (R), green (G), and blue (B), are formed on the side walls of the barrier ribs 8, and on the surface of the dielectric layer 10 between the barrier ribs 8.

Note that the drawing shows that the phosphor layers 9R, 9G, and 9B have the same width in the x direction, however a phosphor layer of a specific color may have a larger width in the x direction in order to balance the luminance of the phosphor layers.

The front panel FP and the back panel BP which have the abovementioned structure are made to face each other so that the lengthwise directions of address electrodes 11 are perpendicular to the display electrodes 4 and 5.

A sealing member that includes a glass having a low melting point such as flit glass is used to seal the peripheries of the front panel FP and the back panel BP so as to enclose the interior section between the panels FP and BP.

In the interior section between the front panel FP and back panel BP which have been sealed in this way, a discharge gas (enclosed gas) which has a composition including a rare gas such as Xe is enclosed at a given pressure (usually approximately 40 kPa–66.5 kPa).

Figure 13:
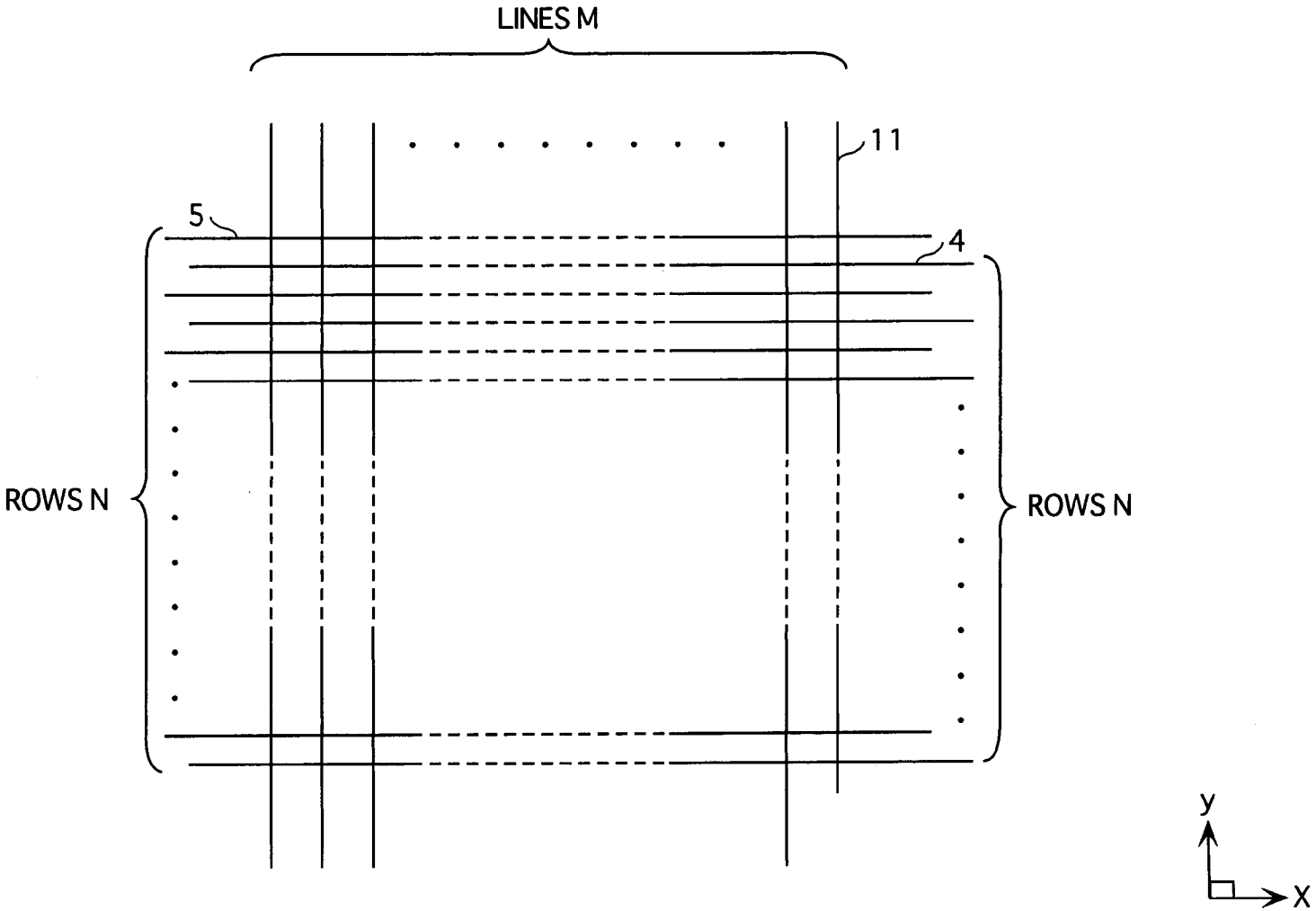
FIG. 13 is a mimetic diagram showing the alignment of the display electrodes and the address electrodes.

By this process, a space between the front panel FP and the back panel BP which is partitioned by the protective layer 7, the phosphor layers 9R, 9G and 9B and pairs of adjacent barrier ribs, forms a discharge space 12. Further, the area in which the co-adjacent pair of display electrodes 4 and 5 and an address electrode 11 are on opposite sides of the discharge space 12, makes up a cell (not shown in drawing) which is used in image display. Here, FIG. 13 shows a matrix formed by a plurality of pairs of PDP unit display electrodes 4 and 5 (rows N) and a plurality of PDP unit address electrodes 11 (lines M).

When the PDP is being driven, discharge is commenced in each cell between the address electrode 11 and one of the display electrodes 4 and 5, or between the display electrodes themselves. Then discharge between the pair of display electrodes 4 and 5 generates a short wavelength ultra violet ray (Xe resonance line, approximate wavelength 147 nm), and the phosphor layers 9R, 9G, and 9B receive the ultraviolet light and emit visible light.

Figure 14:
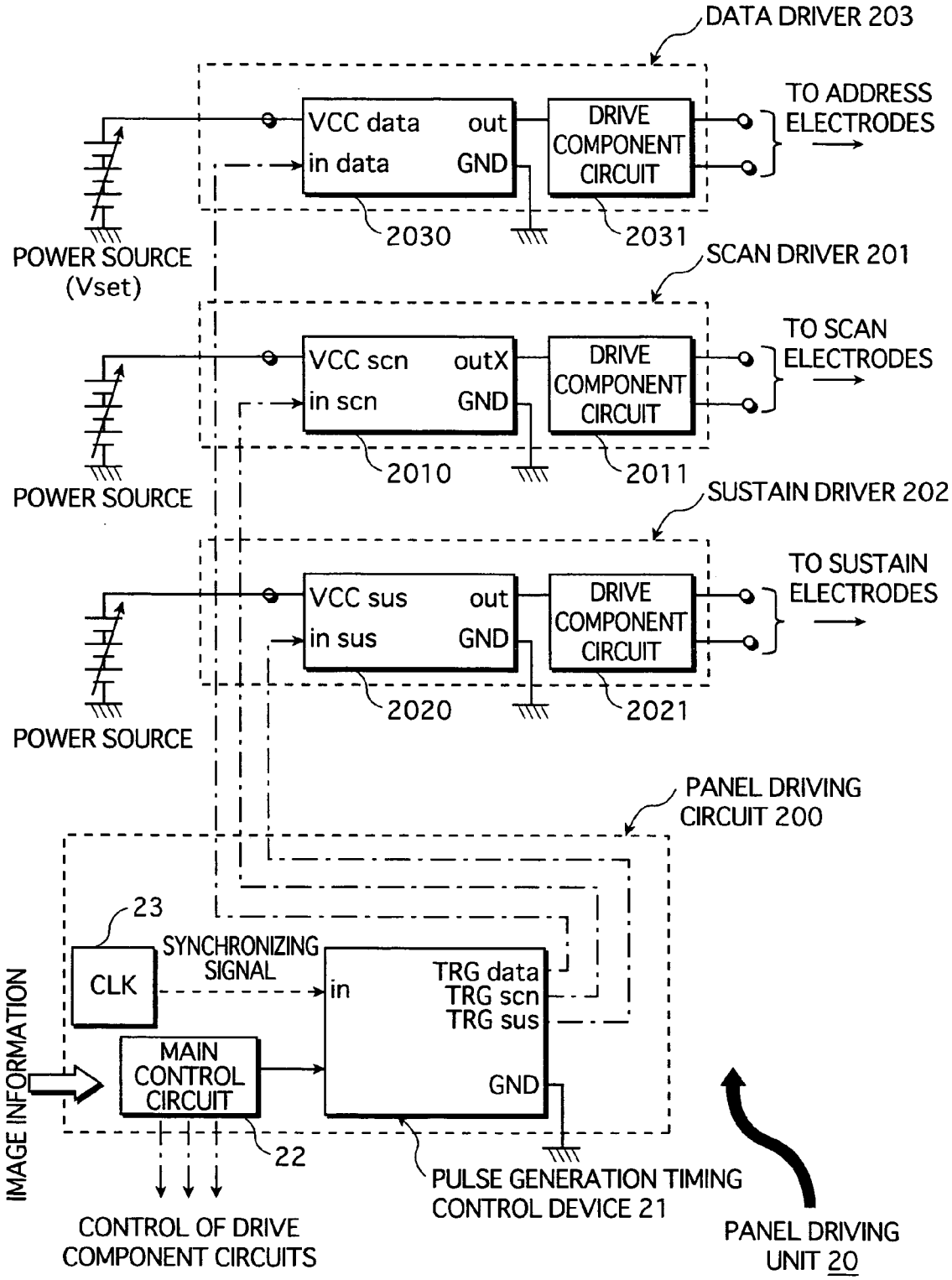
FIG. 14 is a drawing showing the structure of a PDP driving circuit.

Next, the structure of the panel driving unit for driving the PDP unit will be explained. FIG. 14 is a structural drawing of the panel driving unit.

The panel driving unit 20 shown in the drawing is made up of an address driver 203 that is connected to each address electrode 11, a scan driver 201 that is connected to each scan electrode 4, a sustain driver 202 that is connected to each sustain electrode 5, and a panel driving circuit 200 that controls the drivers 201–203, and the like.

The panel driving circuit 200 is inbuilt with a sustain pulse generation timing control device 21, a main control circuit 22, a clock circuit 23 and the like.

The clock circuit 23 is inbuilt with a clock (CLK) generating unit and a PLL (Phase Locked Loop) circuit, and generates a designated sampling clock, namely a synchronization signal, and sends the synchronization signal to the main control circuit 22 and the pulse control device 21.

The main control circuit 22 is inbuilt with a memory unit which is a frame memory for storing image data inputted from an external unit of the PDP unit 10 for a fixed period, and a plurality of image processing circuits (not shown in drawing) for successively extracting stored image data and performing image processing such as gamma correction processing. The synchronization signal generated by the clock circuit 23 is sent to the main control circuit 22, where image information is accepted and processed using various image processing, based on the synchronization signal. Image data which has been processed is sent to drive component circuits 2011, 2021, and 2031 in the drivers 201–203. The main control circuit 22 additionally performs control of the drive component circuits 2011, 2021, and 2031.

The pulse control device 21 controls the timing of pulse generation, and is inbuilt with a commonly-known sequence controller and microcomputer. The pulse control device 21 sends pulses which are based on the sequence of the drive waveform process such as initialization pulses, scan pulses, write pulses, sustain pulses, and erase pulses (TRG scn, TRG sus, TRG data) to the scan driver 201, the sustain driver 202 and the address driver 203 using a designated timing for each respective driver, according to the synchronization signal of the clock circuit 23, and the control program of the microcomputer. By this process, pulse voltages having are applied to display electrodes 4 and 5 and address electrodes 11, to perform screen display.

The waveforms and output timings of the pulses based on the sequence of the drive waveform process are controlled by the microcomputer. The drive waveform process sequence is formed in the microcomputer within the pulse control device 21, by processing the image-processed image data which has been sent from the main control circuit 22.

The scan driver 201, the sustain driver 202, and the address driver 203 are each constructed from an ordinary driver IC (for example data driver; NEC μ PD16306A/B, and scan driver; TI SN755854 can be used), and pulse output devices 2010, 2020, and 2030, and respective drive element circuits 2011, 2021, and 2031, are provided within the drivers.

The pulse output devices 2010, 2020, and 2030 are each connected to a separate external high voltage power source from which power is transmitted. The pulse output devices output a designated voltage obtained from the high voltage power source (VCC scn, VCC sus, VCC data) to the drive component circuits 2011, 2021 and 2031 (out X, out Y, out), based on the pulses sent from the pulse control device 21 (in scn, in sus, in data).

1-2. Basic Drive Waveform Process

Next, the basic drive waveform process of a conventional PDP will be explained. Note that details of a drive waveform process of an ordinary PDP display device are disclosed in Japanese Laid-open Patent Publication No. 6-186927 and Japanese Laid-open Patent Publication No. 5-307935.

Figure 15:
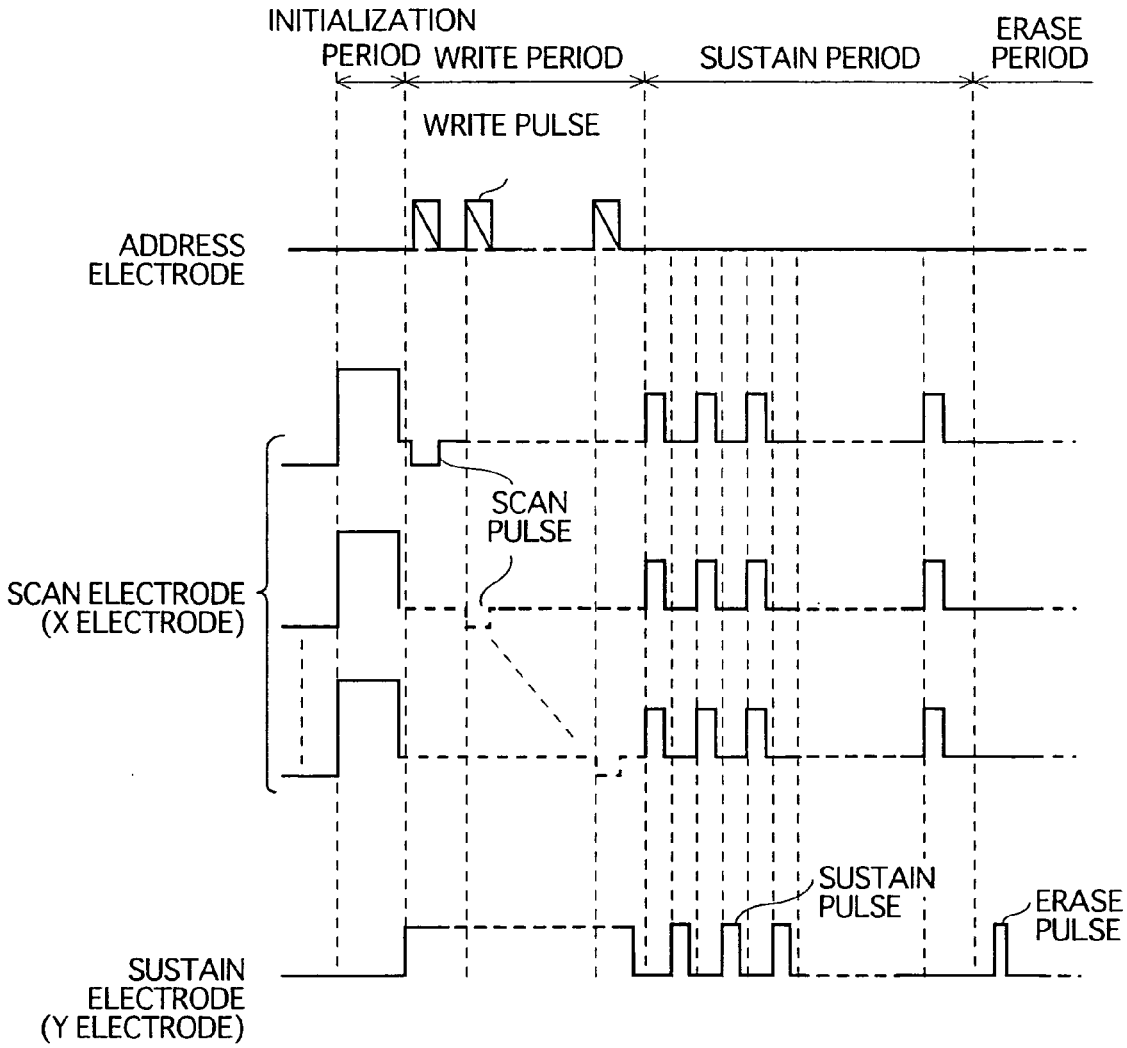
FIG.15 PRIOR ART
FIG. 15 is a drawing showing a drive waveform process of a conventional PDP unit.
Figure 16:
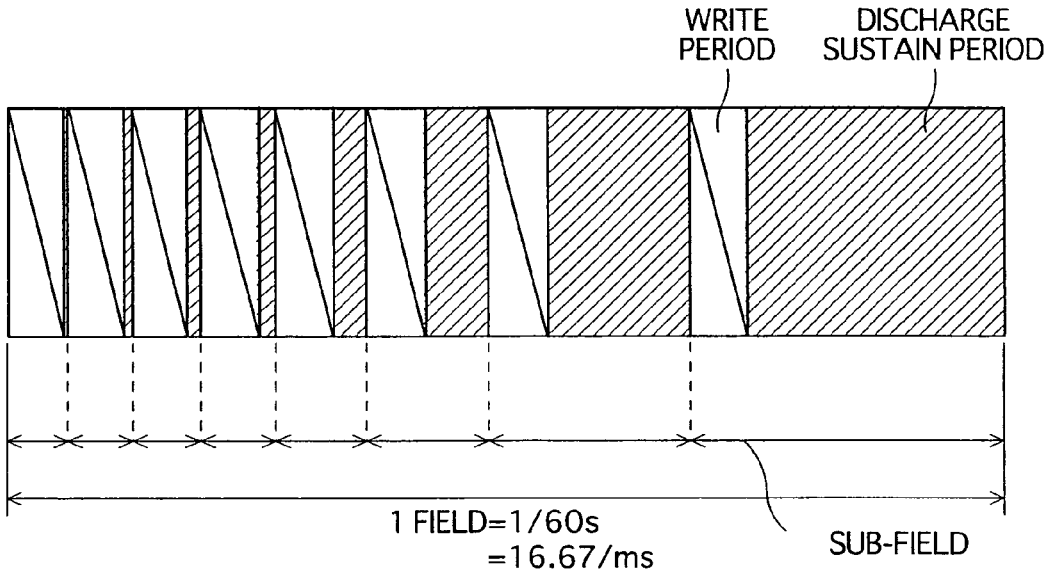
FIG.16 PRIOR ART
FIG. 16 is a drawing showing a structure of subfields within a frame (field).

As shown in FIG. 15, in a subfield, the drive waveform process of the PDP sequentially passes through an initialization period, a write period, a sustain period, and an erase period.

During driving, first, in the initialization period of the subfield, an initialization pulse is applied to the scan electrode 4, and a cell wall charge is initialized.

Next, in the write period, a scan pulse and a write pulse are respectively applied to the scan electrode 4 and sustain electrode 5 which have the greatest value in the y direction (highest position in the PDP unit), and write discharge is performed. This process causes the wall charge to accumulate on the surface of the dielectric layer 6 corresponding to the scan electrode 4 and sustain electrode 5, in each cell. In a similar fashion, a scan pulse and a write pulse are respectively applied to the second and succeeding scan electrodes 4 and sustain electrodes 5, and a wall charge accumulates on the surface of the dielectric layer 6 corresponding to each cell. By performing these pulse applications for all of the display electrodes 4 and 5 which are arranged on the front panel FP, one screen of a latent image is written.

Next, in the sustain period, the address electrode 11 is earthed, and a sustain pulse is applied to the scan electrode 4 and the sustain electrode 5 in an alternating fashion. In a display cell selected by the write pulse in this way, the electric potential of the surface of the dielectric layer 6 exceeds the discharge initializing voltage (Vf), and a sustain discharge is generated in the gap between the pair of display electrodes 4 and 5. A short wavelength ultraviolet ray is generated by the sustain discharge (Xe resonance line of approximate wavelength 147 nm), and the phosphor layers 9R, 9G and 9B are excited by the ultraviolet ray, causing visible light to be generated, so that image display can be performed. The image display is constructed having 60 frame/sec (approximately 16.67 ms/frame), according to a uniform manufacturers' standard.

One frame is made up of eight subfields, and the relative luminance ratios of the subfields are basically assigned binary weights in ascending order of 1, 2, 4, 8, 16, 32, 64, 128. In this explanation a subfield having a write period, a sustain period and an erase period is presented, however in one actual frame, it is predetermined that at least one subfield, in which the relative luminance ratio corresponds to the lowest weight, has only a write period and a sustain period. Further, a subfield corresponding to the weight of level 0 gradation display is made up of only an initialization period and a write period (without scan pulses).

In the erase period, a narrow erase pulse is applied to the sustain electrode 5, to extinguish the wall charge in the cell and extinguish the image.

1-3. Properties and Effects of the First Embodiment

Here, the table of FIG. 11 shows display luminance, and the weights of each relative luminance ratio in a frame corresponding to the presence or absence of a write period and a sustain period in subfields, during low level gradation display (level 0 gradation–level 8 gradation) in a conventional display device. In the table, the sections showing "1" are subfields in which write and sustain discharge are performed. The PDP unit used here is a 13 inch VGA standard PDP unit, however if using a PDP unit of a different size there will be some differences in the determined figures. However, it may be considered that the following properties will appear unchanged.

As shown in the table, because the luminance is 0.15 cd/m$^2$ and only an initializing discharge is generated during the level 0 gradation display, it can be seen that the luminance emitted by the initializing discharge is 0.15 cd/m$^2$. Further, because there is a difference of 4 in the number of sustain pulses during level 1 gradation display (3 sustain pulses) and during level 2 gradation display (7 sustain pulses), and the luminance ratio is 1.8 cd/m$^2$, it can be seen that the luminance emitted per sustain discharge is 0.45 cd/m$^2$. Further, because the arithmetical ratio of luminance during level 0 gradation display and luminance during level 1 gradation display is 2.33 cd/m$^2$, the luminance emitted by the write discharge is calculated to be approximately 1.0 cd/m$^2$.

In this kind of ordinary PDP, the arithmetical ratio of luminance of level 0 gradation display and level 1 gradation display is 2.33 cd/m$^2$, and when comparing this ratio with the ratio in CRT being approximately 0 cd/m$^2$, it can be seen that ordinary PDP display devices have properties wherein transitions in luminance during low level gradation display cannot be displayed as smoothly as in CRTs.

In response to this, even if gradation display time is falsely attempted using error diffusion processing (dither method), because the gradation is originally low, error diffusion noise would be noticeable, and rather than an effective error diffusion result being gained, a new problem of deterioration in picture quality would arise.

Therefore, as a result of diligent investigation by the present inventors, with an aim that emission luminance of 1.2 cd/m$^2$ can be obtained from the initialization pulse and the write discharge, a subfield in which the relative luminance ratio corresponds to the lowest weight in the frame was formed having only 2 periods, the 2 periods being an initialization period and a write period. Unlike the conventional structure, in this subfield sustain pulses are not applied to the display electrodes 4 and 5.

Here the initialization pulse, write pulse, scan pulse, and voltage applied to the sustain electrode in the write period are set at values of 400V, 70V, −70V, and 200V respectively. The values of each of the above pulses can be substantially the same as the conventional values. Note that the values in the following preferred embodiment are also set as the same as the values stated above.

With the drive waveform process described above, in a subfield in which the relative luminance ratio corresponds to the lowest weight, it is possible to reduce the conventional relative luminance ratio of 2.33 cd/m$^2$ by approximately half, to approximately 1.2 cd/m$^2$ (the total of light emission from the initialization pulse and the write pulse), thus a dark light emission display which is closer to 0 cd/m$^2$ can be performed. Accordingly, during the low gradation display of the first embodiment, a gradation display which is nearly as smooth as in a CRT is realized, without having to use error diffusion processing.

Figure 1:
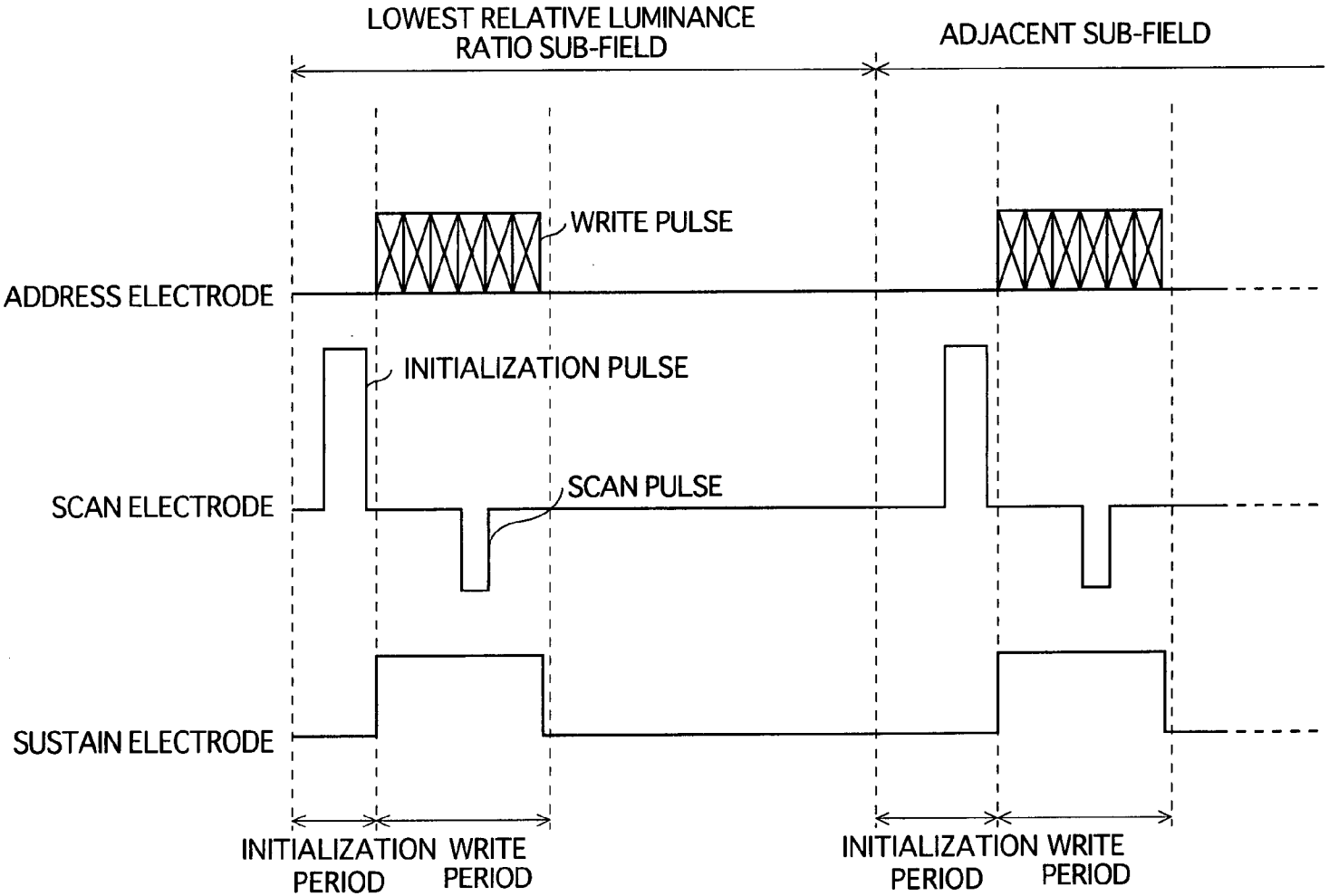
FIG. 1 shows the drive waveform process of the first embodiment.

Further, in the first embodiment, an erase period is unnecessary in the subfield in which the relative luminance ratio corresponds to the lowest weight, as sustain pulses are not applied. Accordingly, there is no light emission caused by an erase pulse. Therefore, as shown in FIG. 1, because transition to the initialization period of the next subfield can be made straight after the write period, it is possible to shorten the driving time. This is convenient in a case where the widths of pulses, for example initialization pulses, write pulses, and scan pulses are set.

Further, conventionally, when performing error diffusion processing on the level 0 gradation display and the level 1 gradation display, a tendency for error diffusion noise to brighten and cause deterioration (graininess) of picture quality is observed. However, in the first embodiment, because the emission luminance of the subfield in which the relative luminance ratio corresponds to the lowest weight is much lower than the conventional emission luminance, noise is not noticable, even if error diffusion processing is performed.

Second Embodiment

Figure 2:
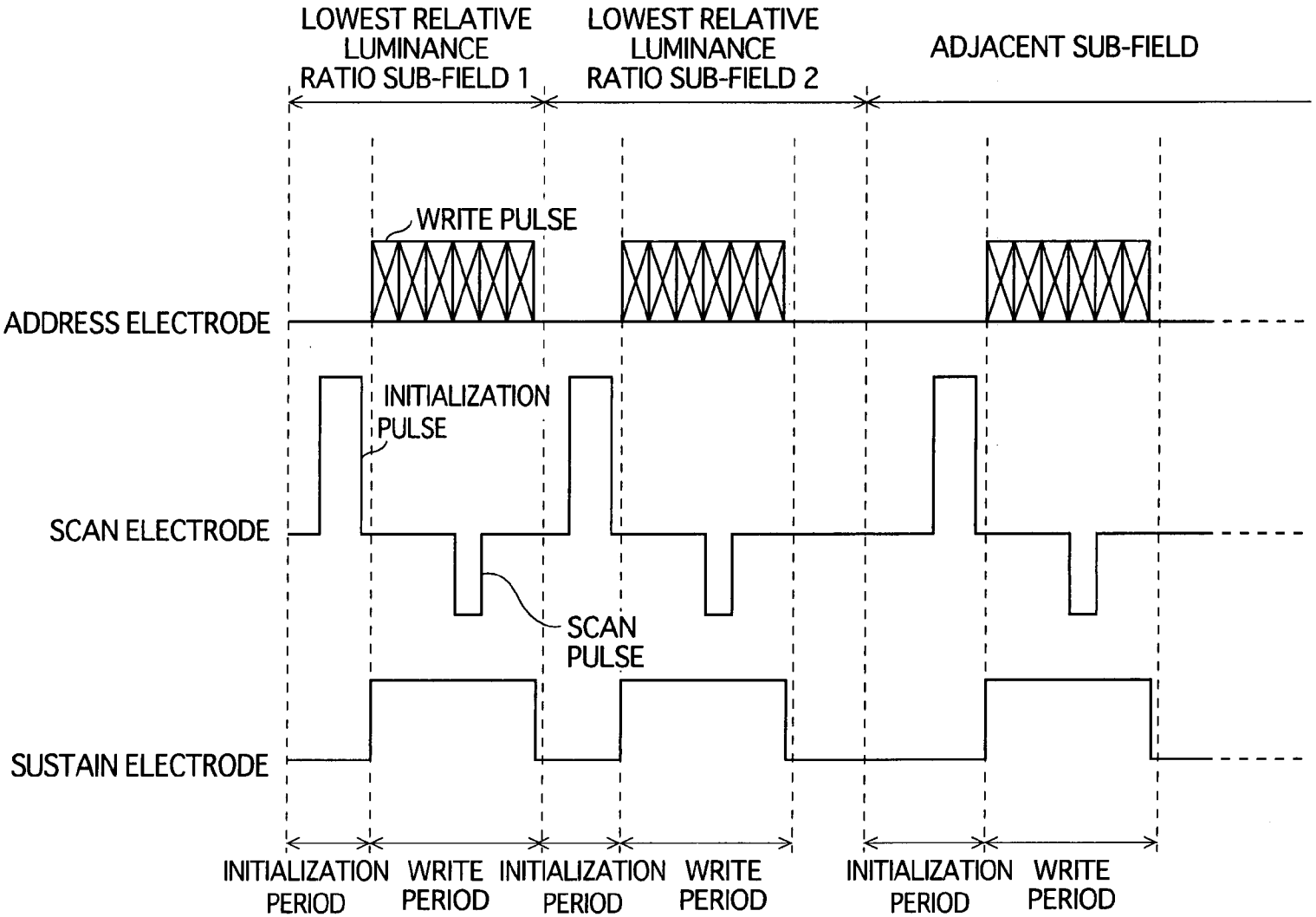
FIG. 2 shows the drive waveform process of the second embodiment.

FIG. 2 is a drawing which shows subfields of the second embodiment during low gradation display.

In the second embodiment, one frame has a drive waveform process in which two consecutive subfields of the eight subfields with different assigned weights each consist of an initialization period and a write period, in a similar fashion to the first embodiment.

Further, in a subfield 2 (the latter of the two subfields), discharge is performed in the initialization period and the write period, in a similar fashion to the first embodiment.

Figure 3A:
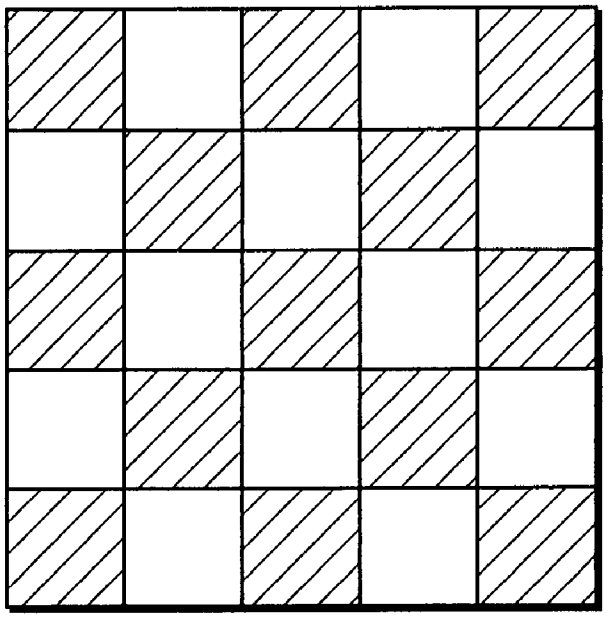
FIGS. 3A and 3B are mimetic diagrams showing the light emission display area in the PDP unit of the second embodiment.
Figure 3B:
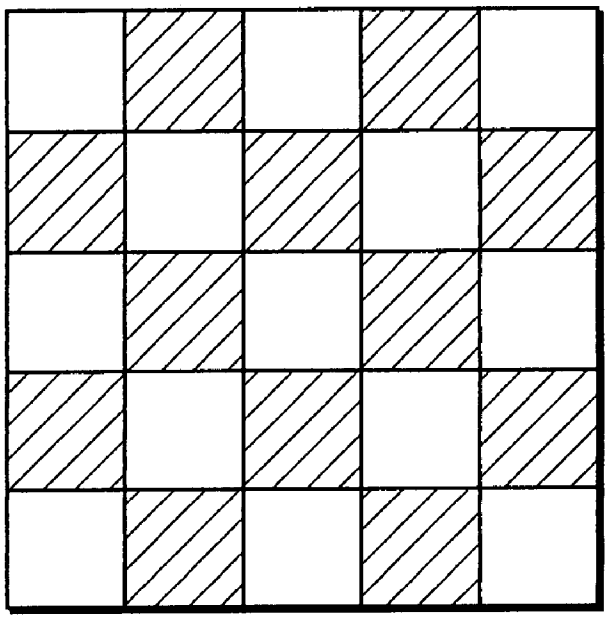
Figure 3B:
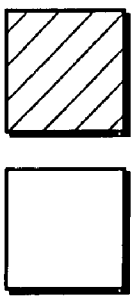

On the other hand, in the preceding subfield 1 of a certain frame, in a low-level gradation display area in which the relative luminance ratio corresponds to the lowest weight, every second cell of a group of adjacent cells is illuminated, as shown in FIG. 3(*a*). Then, in the frame which follows after the subfield 2, the cells which were not illuminated in the previous low-level gradation display area are illuminated, as shown in FIG. 3(*b*). That is to say in the second embodiment, illumination of the display area of the subfield in which the relative luminance ratio corresponds to the lowest weight is shared between two consecutive frames.

The following method is presented as a specific method of illuminating cells as described above.

Figures 4A, 4B, 4C, 4D, 4E, 4F:
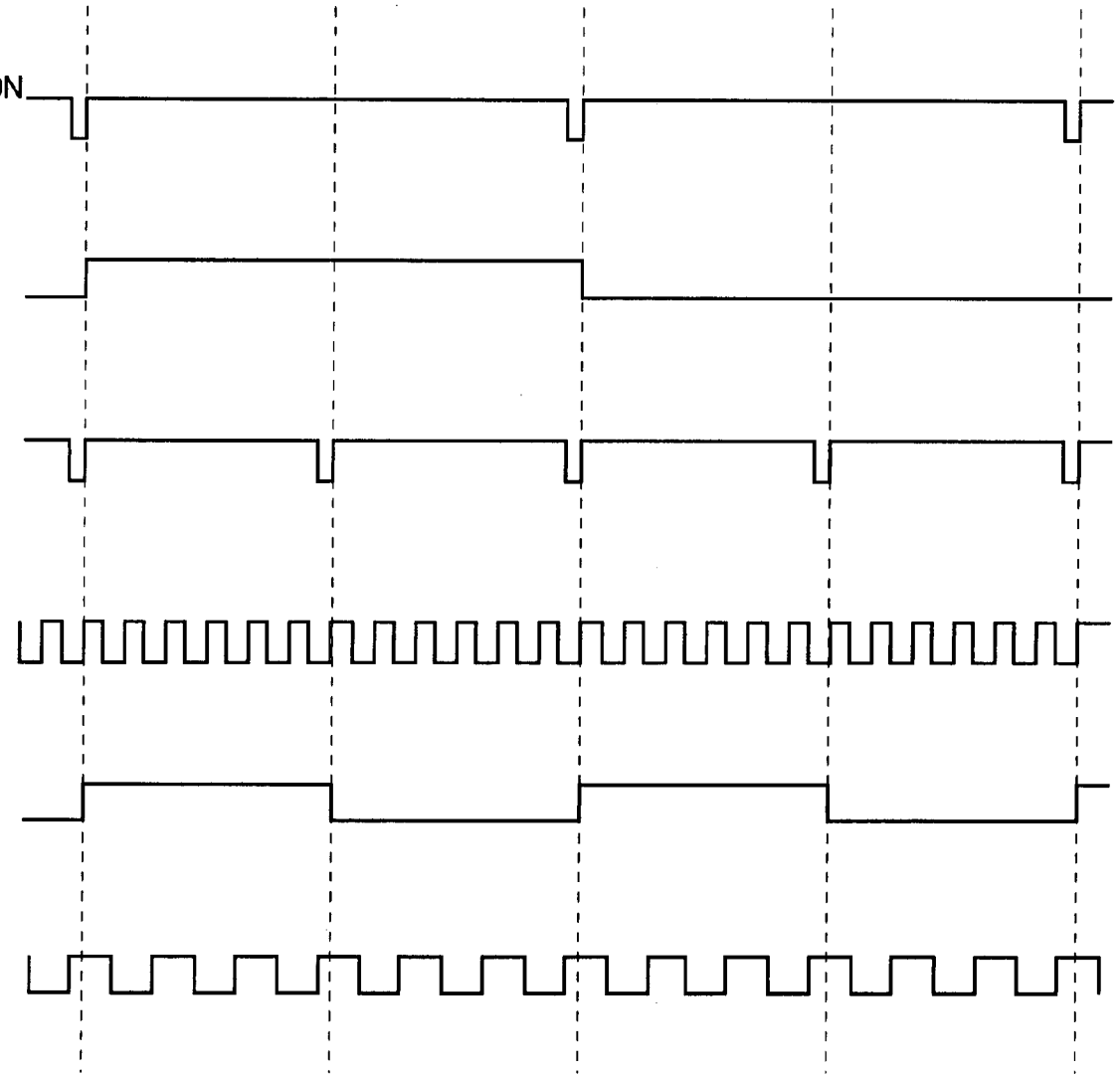
FIGS. 4A through 4F show types of signal waveforms inputted into a PDP driving unit, and the signal waveforms generated by the pulse control apparatus in the second embodiment.

A "vertical synchronization signal (a)", a "horizontal synchronization signal (c)", and a "clock circuit 23 synchronization signal (data clock) (d)", which are shown in FIG. 4, act as signals which control an image. When the panel driving unit 20 takes the signals (a), (c) and (d) from an external device, and forms signals which invert when the (a), (c) and (d) signals change from L level to H level in the pulse control device 21, signals which invert each field (b), signals which invert each line (e), and signals which invert each horizontal dot (cell) (f), are formed.

Of these signals, the signals which invert each line (e) are reset by the vertical synchronization signal (a), and the signals which invert each dot (f) are reset by the horizontal synchronization signal (c). In this case, "being reset" refers to being forcedly set at the L level or the H level at synchronization signal times. An example is shown in the drawing where signals are set at the H level at the synchronization signal times.

Figure 5:
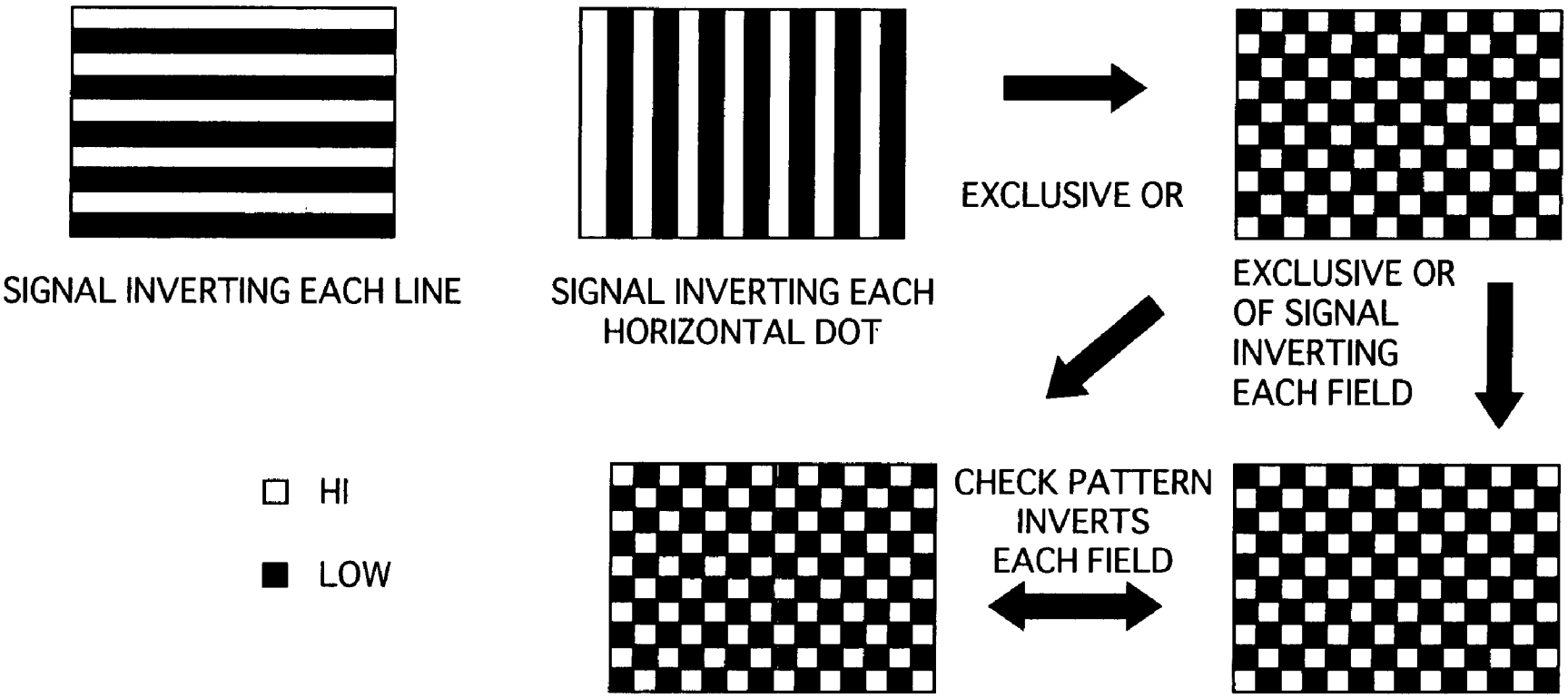
FIG. 5 shows the formation process of the light emission display area of the second embodiment.

When an exclusive OR of the signals which invert each line (e), and the signals which invert each horizontal dot are taken, a checked pattern as shown in FIG. 5 is created. Further, when exclusive disjunction of the checked pattern signal and the signal which inverts per field (b) is taken, a checked pattern signal which inverts per field is created. That is to say, the display area image data of the subfield in which the relative luminance ratio corresponds to the lowest weight, of the image data inputted from an external device according to signals inverting each field (b), each line (e), or each horizontal dot (cell) (f), is stored as pieces of checked-pattern image data in the memory of the PDP driving unit in order, and used in display.

In this way, in the second embodiment, as shown in FIG. 5, a logical AND of data of a subfield and a checked pattern made up of "0" and "1" is taken and the resulting display area is illuminated. At this time, the "0"s and "1"s of the checked pattern invert each field. This process enables false display with a luminance which is half of the conventionally emitted luminance.

Note that in subfield 2, logical AND of a checked pattern is not taken.

According to the abovementioned second embodiment, in the display area of the subfield in which the relative luminance ratio corresponds to the lowest weight, when comparing emission luminance of the display area in which adjacent cells appear to be illuminated alternately in a checked pattern every frame, to full illumination (that is, by the emission luminance in the subfield 2), the light emission of the initialization pulses is equal, although the light emitted by the write pulse can be decreased by half. That is to say, in the second embodiment, it is possible to keep the total emission luminance of the subfield 1, in which the lowest relative luminance ratio corresponds to the lowest weight, at approximately 0.65 cd/m$^2$, being the total of the emission luminance of the initialization pulse (0.15 cd/m$^2$) and the emission luminance of the write discharge (approximately 0.5 cd/m$^2$), which is half of (1.0 cd/m$^2$). This total, being as low as ¼ of the 2.33 cd/m$^2$ emission luminance of a conventional gradation display which was mentioned previously, shows that the second embodiment has superior low gradation display performance.

Further, in the second embodiment, because the emission luminance in subfield 2 is also kept low at approximately 1.2 cd/m$^2$, a plurality of dark, low gradations which are nearer to 0 cd/m$^2$ can be displayed in both subfields 1 and 2.

If error diffusion process is combined with the second embodiment, the error diffusion noise will be barely noticed, and deterioration of the picture quality can be kept to a minimum.

Note that here an example was shown wherein the illumination of adjacent cells in a display area of subfield 1 alternates in consecutive frames, however as the second embodiment is not limited to this driving method, a driving method in which cells are divided into cell groups of several cells, and the illumination of the cell groups alternates in consecutive frames may also be used. However, because the picture in the display area is blurred when cell groups are formed having very large numbers of cells, caution is required particularly for the formation of cell groups in a case where the PDP unit 1 is a high definition PDP, such as a high vision PDP.

Further, in the second embodiment, an example is shown combining each of the drive waveform processes of subfield 1 and subfield 2, which are characteristic of the present invention. However, as the present invention is not limited to a drive waveform process which combines subfield 1 and subfield 2, subfield 1 may be combined with a subfield of the conventional structure instead of subfield 2.

Further, subfield 1 has a structure in which the illumination of adjacent cells in the display area of subfield 1 alternates in two consecutive frames. However, as the present invention is not limited to a case where adjacent cells illuminate alternately, illumination of every second cell, or of every third cell or every greater number of cells, may also be performed, in all of the corresponding display areas of the total of the plurality of consecutive frames. If illumination of cells is performed in this way, the number of illuminated cells per subfield 1 can be reduced to a fraction of the conventional number, therefore enabling even darker display.

Third Embodiment

Figure 6:
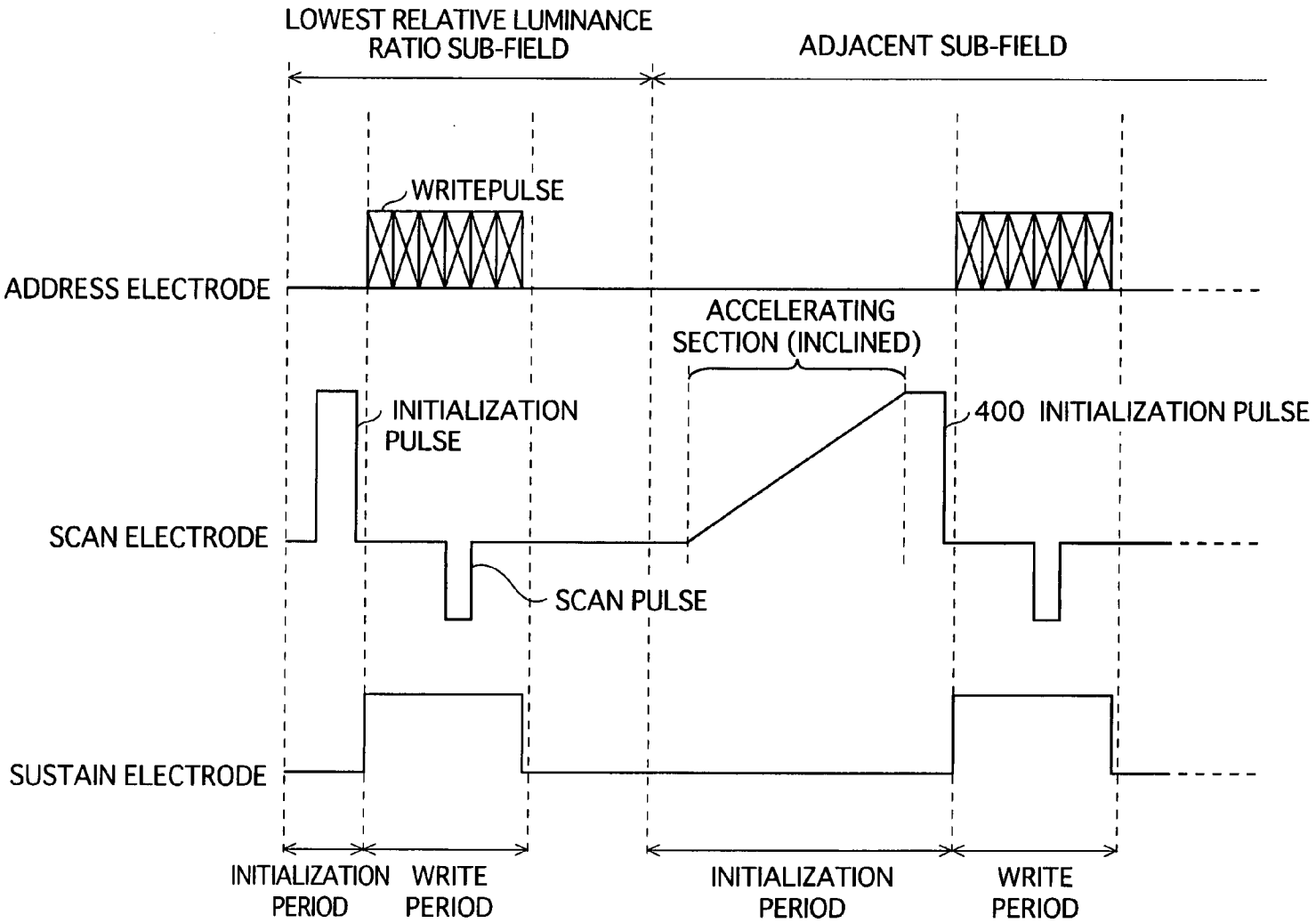
FIG. 6 shows the drive waveform process of the third embodiment.

FIG. 6 is a drawing showing a subfield during low gradation display in the second embodiment.

In the drive waveform process of the third embodiment which is shown in the drawing, firstly, as in the first embodiment, the subfield in which the relative luminance ratio corresponds to the lowest weight consists of two periods, the two periods being the initialization period and the write period. The drive waveform process of the third embodiment also has a characteristic wherein an initialization pulse, which has an inclined accelerating section, is applied in the initialization period of the subfield following after the abovementioned subfield. Concerning the specific incline of the accelerating section, from actual results determined by the present inventors, a maximum incline of approximately 7.5V/μs is considered possible, though it is preferred that the incline be in a range of 1V/μs–3.5V/μs. The maximum value of the initialization pulse may be approximately 400V, which is the conventional maximum value.

Generation of erroneous discharge (of for example 0.5 cd/m$^2$), which occurs when the wall charge originating from the discharge generated in the subfield in which the relative luminance ratio corresponds to the lowest weight is brought into the next subfield (especially the wall charge generated by the write discharge in the write period), is effectively prevented in this kind of drive waveform process which applies an initialization pulse having an accelerating section. That is to say, in the third embodiment, because the wall charge remaining in a cell from the previous subfield is gradually initialized by the initialization pulse 400 having an inclined accelerating section, and the electric potential between the display electrodes 4 and 5, or between the display electrodes 4 and 5 and the address electrode 11 decreases, occurrence of spasmodic discharge is avoided. Accordingly, in the subfield in which the relative luminance ratio corresponds to the lowest weight, and the next consecutive subfield, the occurrence of bright erroneous discharge which is undesirable for image display, and the carrying over of the erroneous discharge into the sustain period, can be effectively avoided, thus enabling good quality low gradation display.

Figure 7:
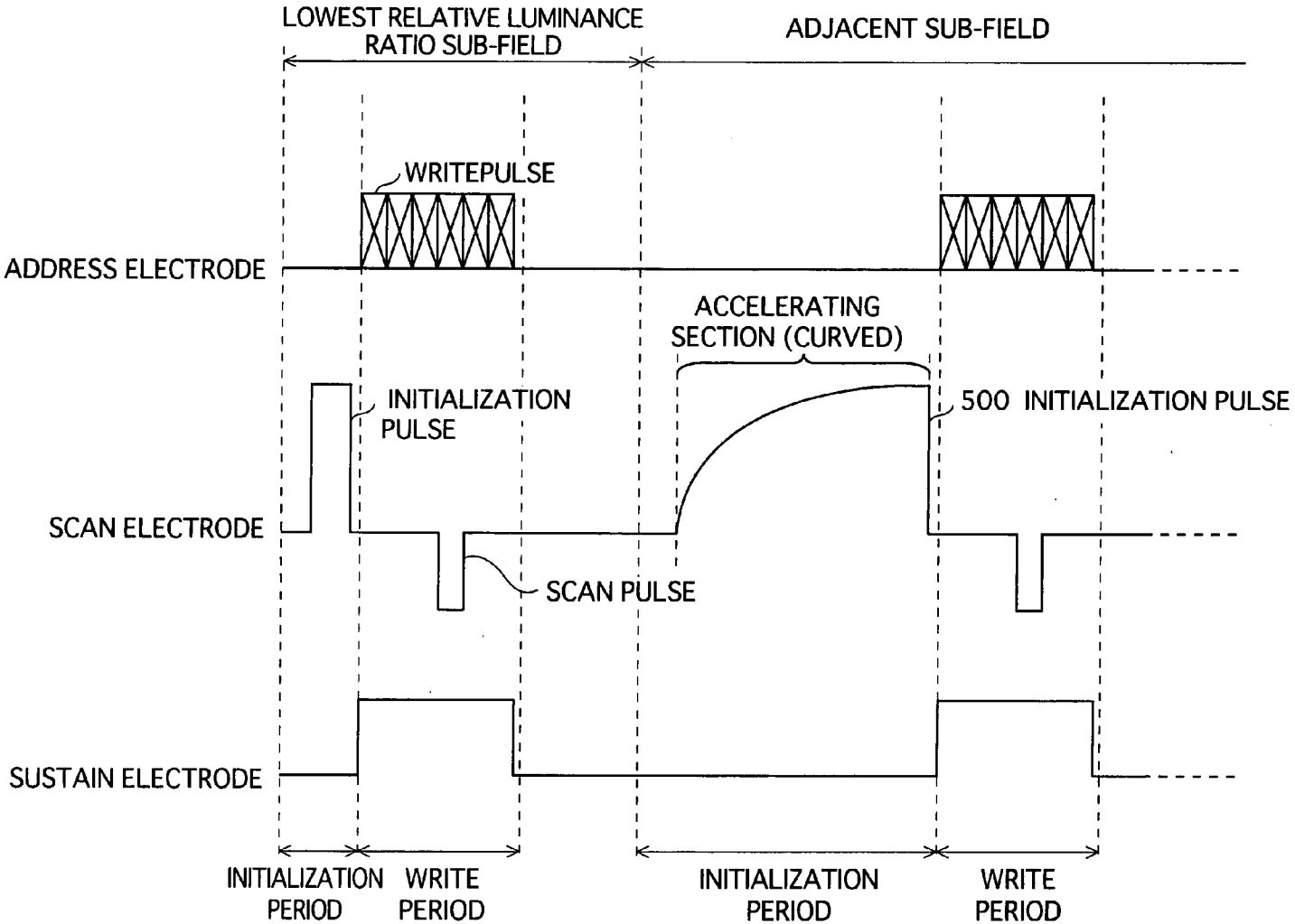
FIG. 7 shows a drive waveform process (variation) of the third embodiment.

Note that as the initialization pulse having an accelerating section is not limited to the pattern of the abovementioned inclined initialization pulse 400, an initialization pulse such as an initialization pulse 500 having a curved accelerating section shown in FIG. 7 may also be used. In the case of the initialization pulse 500 shown in the drawing, the wall charge in the cell is smoothly initialized by the initialization pulse 500 based on a gradually accelerating curve using the curve function expressed as $f(x)=\{1-(1/e)\ x\}^{1/2}$, without causing any noticeable erroneous discharge.

Further, other than the above function, the gradually accelerating section curve may be formed based on a trigonometric function such as a sine waveform, (sin curve) or a cosine waveform (cos curve), or a type of exponential function or high-order function. However it is preferable to actually verify whether or not the occurrence of noticeable erroneous discharge is effectively prevented by the accelerating section having an arbitrary curve, using an oscilloscope or a microscope for discharge verification.

Figure 8:
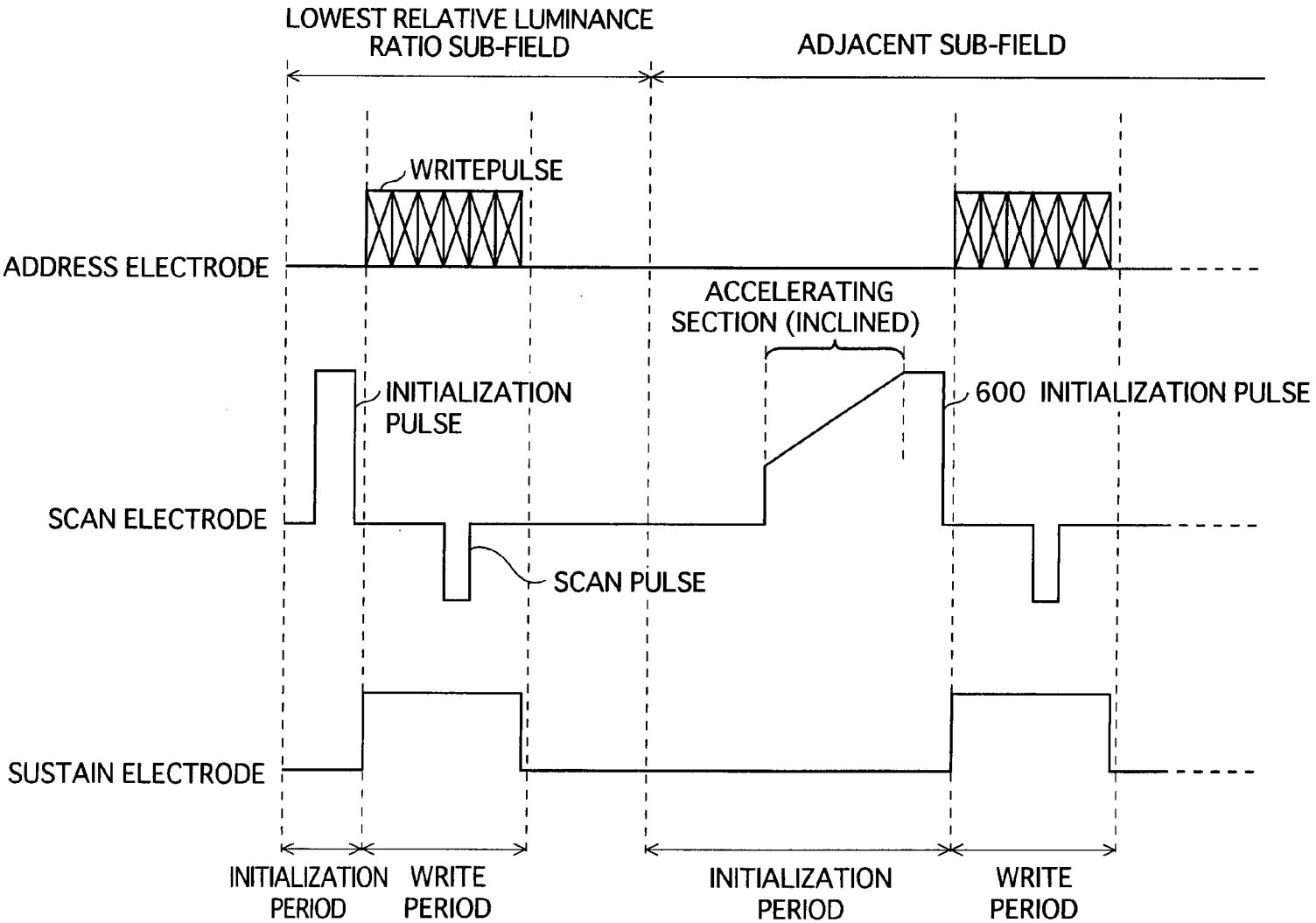
FIG. 8 shows a drive waveform process (variation) of the third embodiment.
Figure 9:
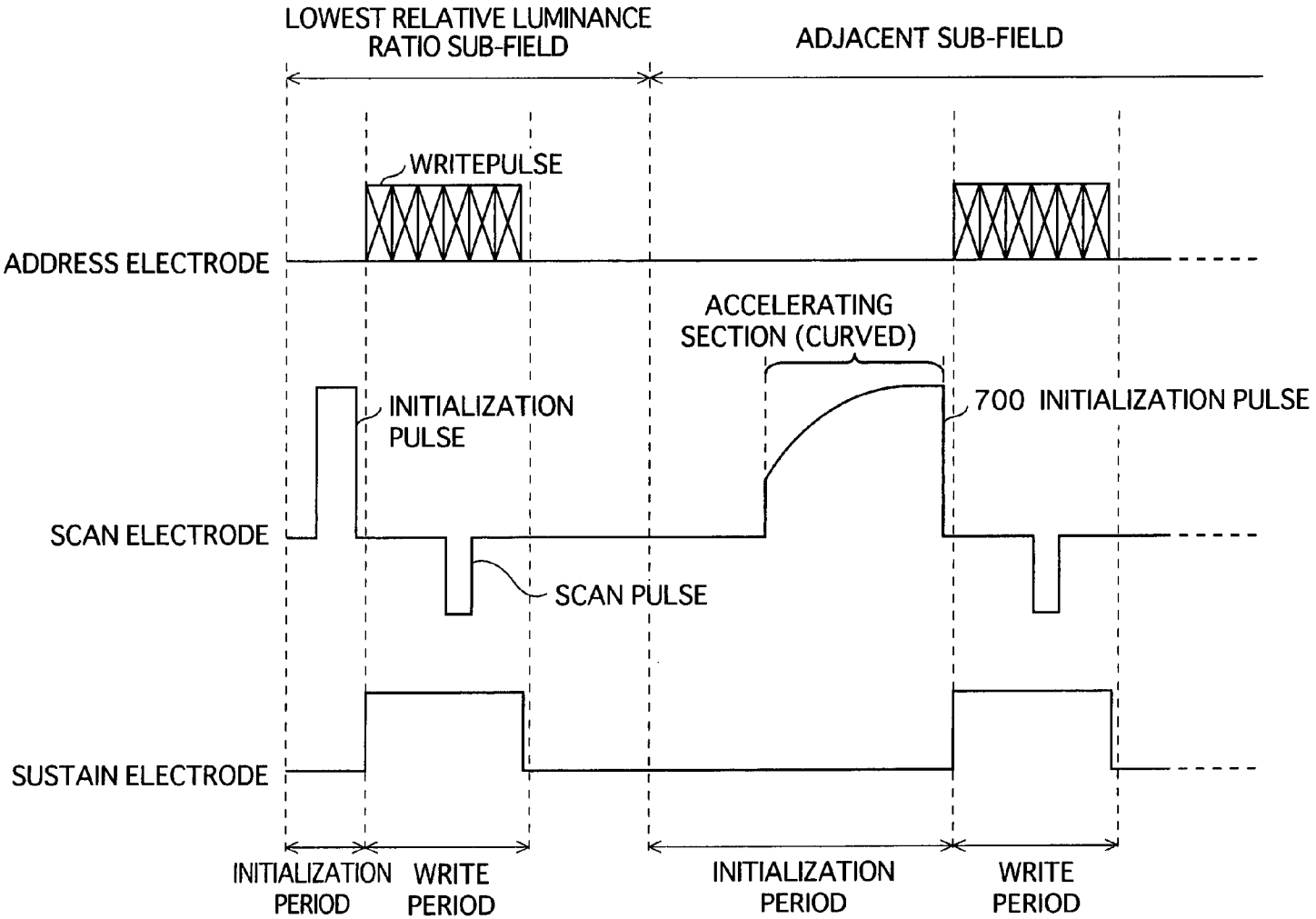
FIG. 9 shows a drive waveform process (variation) of the third embodiment.

Note that it is possible that the accelerating section has a form in which the initialization pulse is steeply raised (raised by 150V in this case) in a range in which erroneous discharge will not occur, as shown in a pulse waveform 600 of FIG. 8 and an exponential function waveform 700 of FIG. 9. The initialization pulse being raised in such a way allows the width of the initialization pulse to be reduced to a certain extent, therefore being advantageous in enabling a reduction in the driving time.

<Other Items>

Figure 10:
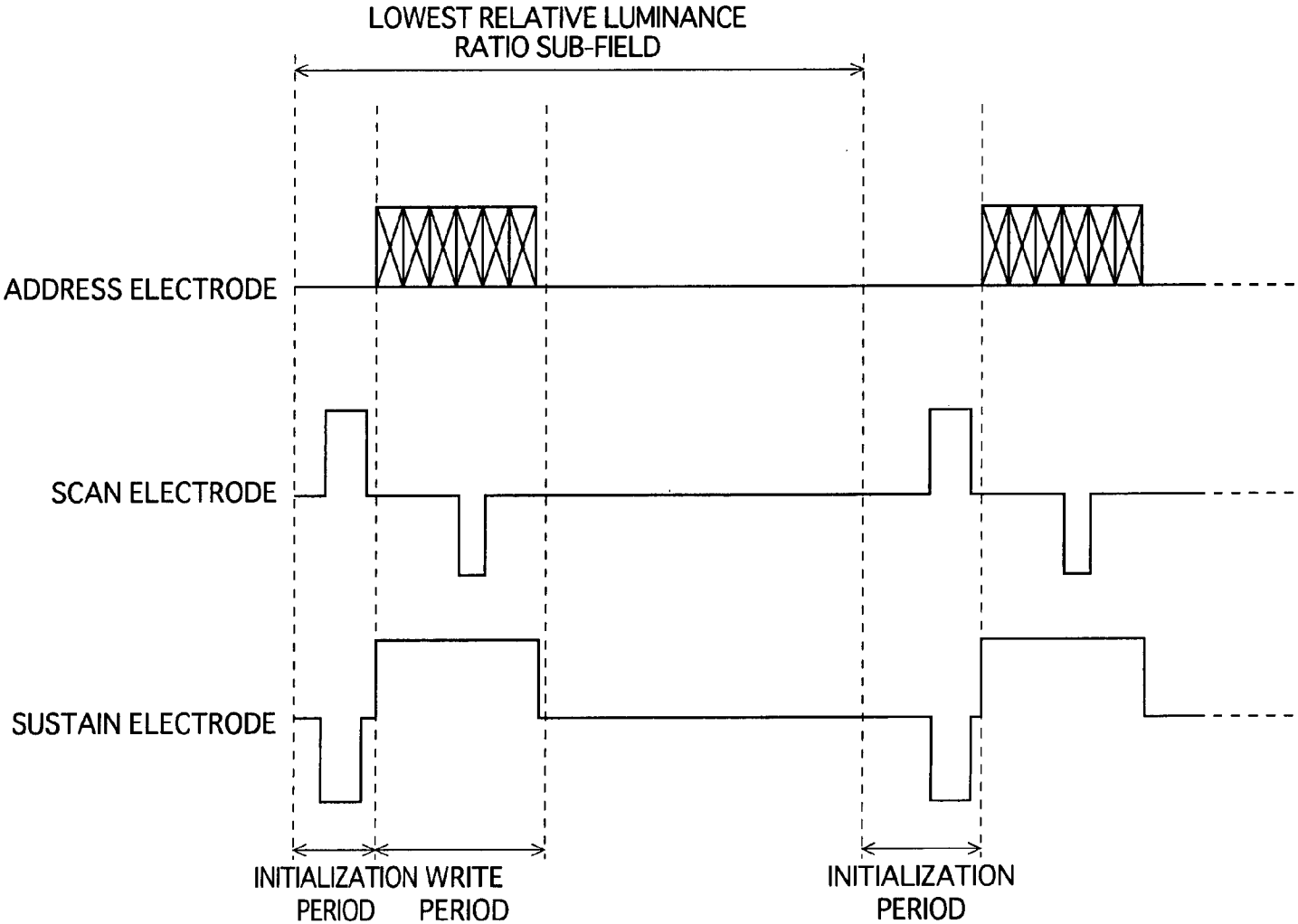
FIG. 10 shows a variation of the drive waveform process of the present invention.

The drive waveform process of the present invention may be formed from differential waveforms, by applying pulses of suitable voltages to both the scan electrode 4 and the sustain electrode 5 in a subfield. Here in the drive waveform process of FIG. 10, the initialization pulse (differential waveform 400) is made up of the total of 200V applied to the scan electrode 4, and −200V applied to the sustain electrode 5. In a similar fashion, the scan pulse, write pulse, and the initialization pulse having an accelerating section shown in the third embodiment, may also be made up of differential waveforms. When differential waveforms such as those described above make up these pulses, the individual voltages to be applied when each of the scan driver 201, the sustain driver 202 and the address driver 203 are supplied with electricity are lowered, therefore the use of a highly voltage-resistant driver IC is unnecessary, and the use of such waveforms can be expected to have a cost-wise advantage.

Note that during PDP driving time there may also be cases where the total of 256 gradations are expressed by each frame being made up of 12 subfields, rather than eight subfields as in the previous example. In this case the weights of each subfield are assigned in an ascending order such as 1, 2, 4, 6, 10, 14, 19, 26, 33, 47, 53. This is the same as in the case of one field made up of eight subfields for gradations 0 to 7, however the eighth gradation illuminates the subfields 2 and 4. By further changing the assigned weights, a display of 512 gradation or higher is made possible. This kind of frame structure may also be applied to the present invention.

INDUSTRIAL APPLICABILITY

The present invention can be applied to PDPs used in display devices of information terminal devices and computers, and television image display devices.

The invention claimed is:

1. A PDP display apparatus driving method for performing multi-level gradation display by constituting one frame of a plurality of subfields assigned different weights, wherein among the plurality of subfields in the frame, a subfield in which a relative luminance ratio corresponds to a lowest weight consists of two periods only, the two periods being an initialization period and a write period, and in the subfield, level 1 gradation display is performed by a combination of initialization discharge and write discharge, with luminance higher than luminance of level 0 gradation display performed by the initialization discharge alone.

2. The driving method of claim 1, wherein the PDP display apparatus includes a PDP unit with a plurality of cells arranged in a matrix formation, in a first subfield, in which the relative luminance ratio corresponds to a lowest weight in a first frame, discharge is generated in the write period within a first group of cells selected from a display area having the lowest relative luminance ratio, and in a second subfield, in which the relative luminance ratio corresponds to a lowest weight in a second frame that is successive to the first frame, discharge is generated in the write period within a second group of cells selected from the display area having the lowest relative luminance ratio, in which discharge was not generated in the first subfield.

3. The PDP driving method of claim 2, wherein in a subfield in which a relative luminance ratio corresponds to a second lowest weight among the plurality of subfields in the frame, display is performed according to discharge in two periods only, the two periods being the initialization period and the write period.

4. The PDP driving method of claim 1, wherein an initialization pulse which includes an accelerating shape is applied in the initialization period of a subfield which succeeds the subfield having the lowest relative luminance ratio in the frame.

5. The PDP driving method of claim 3, wherein the accelerating shape is selected from inclined, stepped, exponentially curved, and trigonometrically curved shapes.

6. A PDP display apparatus comprising:

(a) a PDP unit composed of a first substrate having a plurality of pairs of display electrodes formed on a main surface thereof, and a second substrate having a plurality of data electrodes, a plurality of barrier ribs, and phosphor layers formed on a main surface thereof, the barrier ribs being aligned in a lengthwise direction of the data electrodes, and the phosphor layers being formed between pairs of adjacent barrier ribs, the first and second substrates being arranged so that the main surfaces face each other, and the lengthwise directions of the display electrodes and the data electrodes cross each other, and (b) a panel driving unit operable to drive the PDP unit by applying a voltage to an arbitrary pair of display electrodes and an arbitrary data electrode, based on a drive waveform process having a frame composed of a plurality of subfields assigned different weights, wherein the panel driving unit constitutes a subfield having a lowest relative luminance ratio of the frame by two periods only, the two periods being an initialization period and a write period, and in the subfield, applies voltage to the data electrodes and the plurality of pairs of display electrodes according to the two periods, so that level 1 gradation display is performed by a combination of initialization discharge and write discharge with luminance higher than luminance of level 0 gradation display performed by the initialization discharge alone.

7. The PDP display apparatus of claim 6, wherein the PDP unit has cells that are aligned corresponding to intersecting parts of the lengthwise directions of the display electrodes and the data electrodes, the PDP being of a construction wherein in the write period of the first subfield in which the relative luminance ratio corresponds to the lowest weight in the first frame, a discharge is generated in every second cell of the display area having the lowest relative luminance ratio, and in a second subfield, in which the relative luminance ratio corresponds to a lowest weight in a second frame that is successive to the first frame, discharge is generated in the write period within cells selected from the display area having the lowest relative luminance ratio, in which discharge was not generated in the first subfield.

8. The PDP of claim 6, wherein in the subfield that succeeds the subfield having the lowest relative luminance ratio in the frame, an initialization pulse that includes an accelerating shape is applied in the initialization period.

9. The PDP of claim 8, wherein the accelerating shape is selected from inclined, stepped, exponentially curved, and trigonometrically curved shapes.

* * * * *